US005772184A

United States Patent [19]

Zaguroli, Jr.

[11] Patent Number: 5,772,184

[45] Date of Patent: Jun. 30, 1998

[54] LOAD SUPPORT MOUNTED CONTROL ARRANGEMENT FOR FLUID PRESSURE OPERATED HOIST

[75] Inventor: James Zaguroli, Jr., Drayton Plains, Mich.

[73] Assignee: Knight Industries, Inc., Auburn Hills, Mich.

[21] Appl. No.: 854,593

[22] Filed: May 12, 1997

Related U.S. Application Data

[63] Continuation of Ser. No. 591,779, Jan. 25, 1996, abandoned.

[51] Int. Cl.[6] ..... B66D 1/08

[52] U.S. Cl. ..... 254/361; 251/294

[58] Field of Search ..... 254/360, 361; 251/294; 137/357

[56] References Cited

U.S. PATENT DOCUMENTS

| | | | |
|---|---|---|---|
| 1,630,810 | 5/1927 | Simpson . | |
| 3,057,162 | 10/1962 | Lee | 254/323 X |
| 3,125,200 | 3/1964 | Kaman | 254/360 X |
| 3,554,091 | 1/1971 | Spyridakis . | |
| 3,756,563 | 9/1973 | Stone | 254/361 X |
| 3,856,266 | 12/1974 | McKendrick . | |
| 3,933,388 | 1/1976 | Conboy | 254/360 X |
| 3,960,362 | 6/1976 | Griffiths et al. | 254/360 X |
| 3,998,432 | 12/1976 | Uldricks et al. . | |
| 4,243,060 | 1/1981 | McKendrick . | |
| 4,445,538 | 5/1984 | Bilski . | |

*Primary Examiner*—Donald P. Walsh
*Assistant Examiner*—Emmanuel M. Marcelo
*Attorney, Agent, or Firm*—John R. Benefiel

[57] ABSTRACT

A control arrangement for a fluid pressure operated hoist has a load mounted handle assembly including tubular handle portion slidable on a support rod attached to the hoist cable, and a bracket fixed at one end to the handle and extending alongside and offset from said support rod. A three position spring centered valve is mounted to the bracket, with a pair of pins each engaging one end of a valve element and a respective fixed flange on the support rod allowing valve operation by movement of the handle to block, vent, or pressurize a hoist fluid chamber to hold, lower, or raise the load.

4 Claims, 2 Drawing Sheets

LOAD SUPPORT MOUNTED CONTROL ARRANGEMENT FOR FLUID PRESSURE OPERATED HOIST

This is a continuation of Ser. No. 08/591,779, filed on Jan. 25, 1996 now abandoned.

BACKGROUND OF THE INVENTION

This invention concerns fluid pressure operated hoists used for raising and lowering loads. Such hoists are often mounted on overhead trolley rails for use in production situations where items must be repetitively raised and lowered and moved from one location to another, as in unloading and assembly operations. Since efficiency is important in production situations, there have heretofore been devised hoist controls which are located on the load support so as to be readily hand operated while the operator is moving the load. This enables a load to be raised and/or lowered while being shifted to a new location at the same time.

Air pressure operated balancing hoists have usually been employed for such applications, since the air balancing feature is often desirable for positioning heavy load items at a particular height, and such air balancing hoists are easily converted to hand-controlled hoists.

U.S. Pat. No. 4,445,538 issued on May 1, 1984 for a "Bidirectional Control Valve" and U.S. Pat. No. 3,554,091 issued on Jan. 12, 1971 for a "Coupling and Power Control Device" both describe a valve housing mounted to a load cable, with a control sleeve which is movable on the housing to either pressurize or vent a hoist working chamber to cause up or down movement of a supported load when the sleeve is released, the valve assumes a blocking condition which supports the load at a fixed height. The valves used in the control shown in those patents require a fairly high force to open and close, making fine control relatively difficult due to the effort required.

Furthermore, the large diameter of the sleeve makes grasping of the sleeve cumbersome.

U.S. Pat. No. 4,243,060 issued on Jan. 6, 1981 for "Fluid Control Valve" uses a spool valve to reduce the effort required, but still requires the large diameter valve housing to be grasped to operate the valving control.

Another disadvantage of that design is that the spool valve element is directly attached to the load cable, complicating assembly and also any valve maintenance or repair as the removal of the valve is made difficult by being attached to the load cable.

A special valve configuration is also required, other than commercially available valves, increasing the cost.

It is the object of the present invention to provide a hand operated valve control for a fluid pressure operated hoist which has an easily grasped control handle, which does not require substantial effort to operate, and in which a three position valve included is easily removed for maintenance and repair and can be of a conventional type commercially available at moderate cost.

SUMMARY OF THE INVENTION

The above object and others which will be appreciated upon a reading of the present application are achieved by a handle assembly slidably received over a support rod adapted to be connected to the load. The handle assembly includes an easily grasped tubular handle portion of a diameter only slightly greater than the support rod, with an offset bracket fixed to the tubular handle portion and extending axially therefrom. A slider block is received over the support rod and a valve block is attached to the bracket and slider block.

The valve block may be a commercially available pneumatic three position valve, including a spring centered spool valve. External protruding pins are provided engaging opposite ends of the spool valve with one end and also engaging respective flanges fixed on the support rod with their opposite ends.

Fluid connections are made to the hoist air chamber so that when the tubular handle is pulled down, the air chamber is vented through the valve and the load is lowered, and when the tubular handle is raised, a pressure source is connected to the chamber and the load is raised. The valve element is spring centered to be in a blocking position when the handle is released, holding the load at a stationary position.

DETAILED DESCRIPTION

Figure 1:
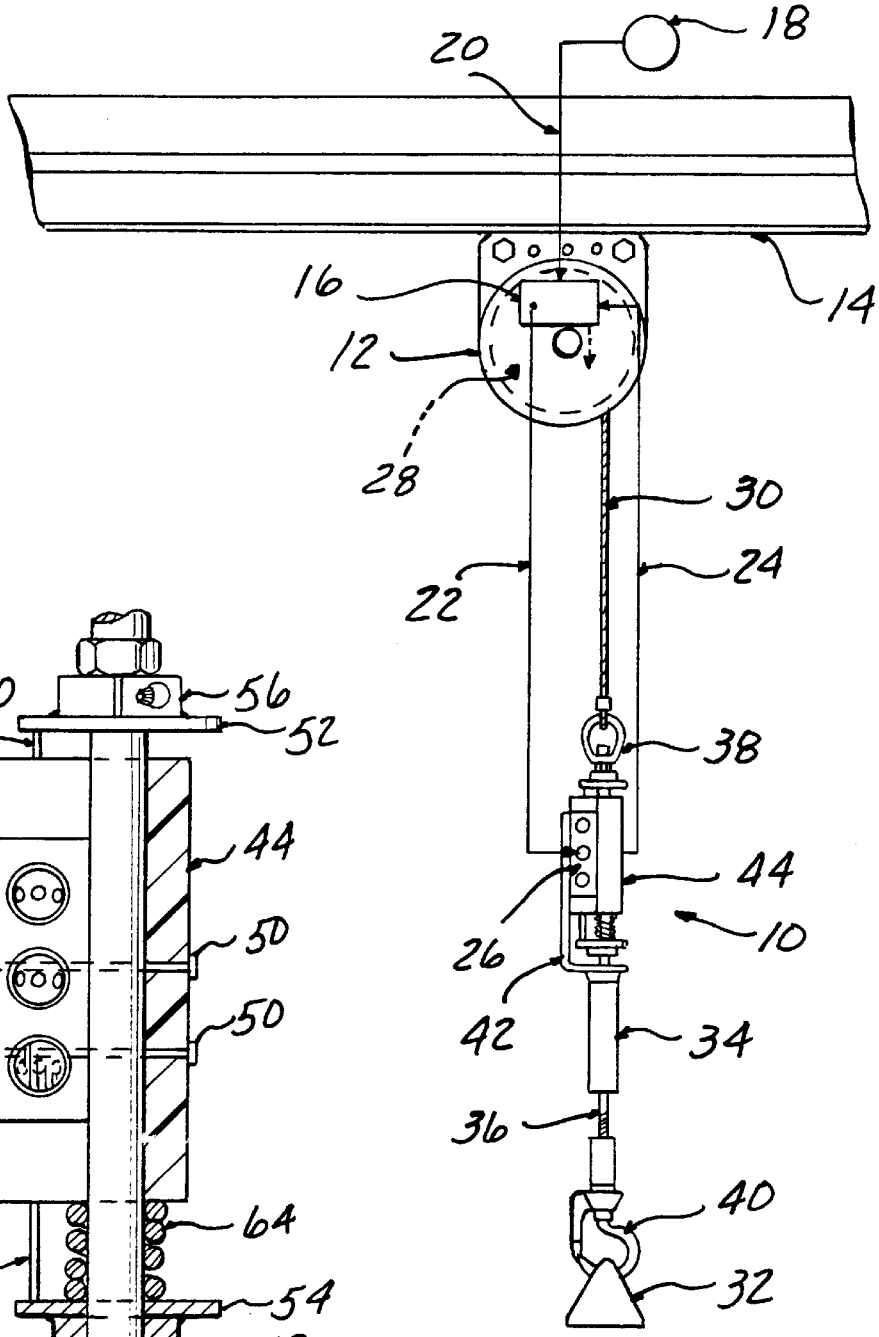
FIG. 1 is a side elevational view of an air operated hoist and a load support mounted control arrangement according to the present invention, with fluid connections shown schematically.
Figure 2:
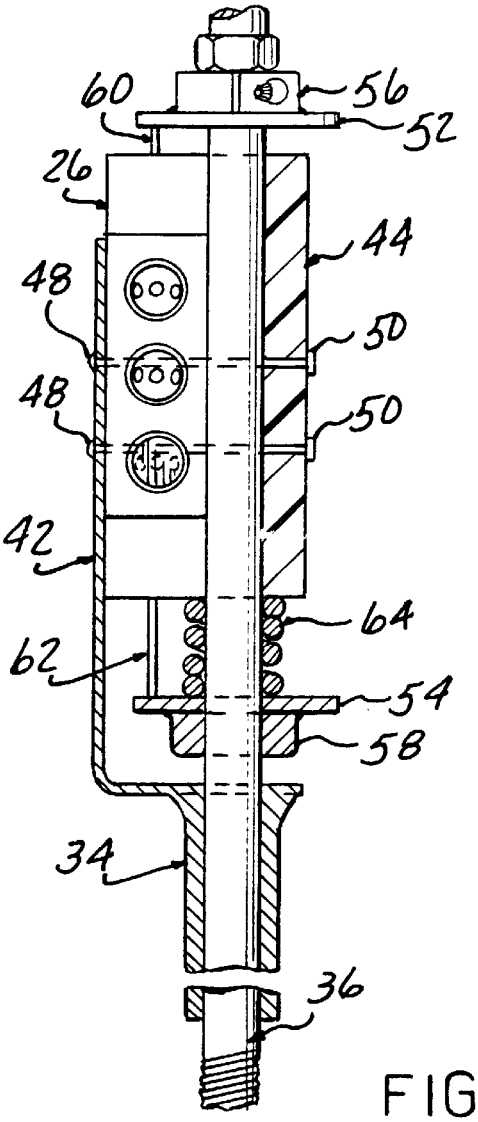
FIG. 2 is an enlarged, partially sectional view of the control handle assembly according to the present invention, shown with the pressure hoses and fittings removed.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a load mounted hoist control handle assembly 10 according to the present invention is included in a control arrangement for an air pressure operated hoist 12, mounted for rolling movement along an overhead trolley rail 14 in the manner well known in the art.

A manifold 16 is fixed to the hoist 12 and has a source of air pressure 18 connected thereto via line 20 shown schematically. A pair of pressure lines 22, 24 connected to the manifold 16 and a valve block 26 mounted to the control handle assembly 10 provide control over the air pressure exerted in an internal operating chamber 28 within the air hoist 12.

The air hoist 12 is of a type well known in the art shown in U.S. Pat. No. 5,370,367 issued on Dec. 6, 1994 and will not be here described in detail. Suffice it to say that the hoist 12 includes an axially movable spool within the hoist, on which is wound a flexible load supporting element such as a cable 30 or chain.

When air pressure of a predetermined magnitude is exerted in the chamber 28, the spool is shifted axially and caused to rotate on a ball screw so that the cable 30 is wound to raise the load 32. When pressure is released, the cable 30 is allowed to unwind to lower the load 32. With the chamber 28 blocked, the load is supported at a stationary height.

The control handle assembly 10 allows the user to selectively pressurize or vent the air hoist chamber to raise or lower the load 32 by up or down movement of a tubular handle portion 34.

The tubular handle portion 34 is slidably fit over a support rod 36, which is threaded at either end to allow attachment of a cable eye 38 and a load hook 40.

Figure 3:
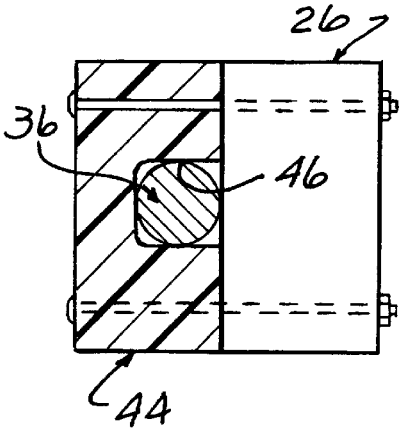
FIG. 3 is a transverse sectional view taken through a portion of the control handle assembly shown in FIGS. 1 and 2.

The tubular handle portion 34 is affixed to a bracket plate 42 which extends upwardly alongside and offset from the support rod 36. This provides a space to accommodate the valve block 26. A slider block 44 is formed with a lengthwise channel 46 (FIG. 3) providing a sliding fit to the operating rod 36 with sufficient clearance to allow free up and down movement on the operating rod 36.

The slider block 44 is attached to the bracket plate 42 and valve block 26 by a series of screws 48 and nuts 50. The operating rod 36 has an upper flange 52 and a lower flange 54 fixed thereon at axially spaced locations by means of split collars 56, 58 integral therewith, creating an axial space to accommodate the valve block 26.

An upper pin 60 protrudes from the upper end of the valve block 26 and has one end which engages upper flange 52, and a lower pin 62 protrudes from the lower end of the valve block and has an end which engages the lower flange 54.

In addition, a compression spring 64 is compressed between flange 54 fixed to the operating rod 36 and the lower end of the slider block 44. The pins 60, 62 each have an opposite end which respectively engages the opposite ends of a valve spool element 66 included in the valve block 26.

Figure 4:
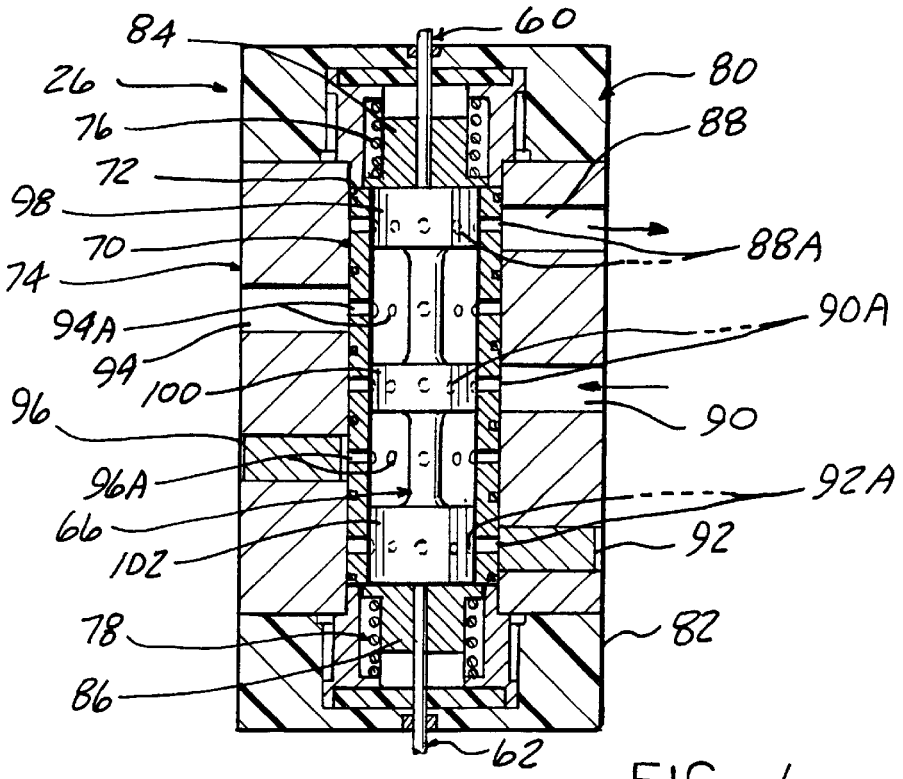
FIG. 4 is an enlarged longitudinal view taken through the valve block included in the control arrangement shown in FIGS. 1 and 2.

The valve block 26 is preferably a commercially available three position valve, such as a Numatics™ L2 series. Such valves feature a lapped spool 66 and sleeve 70 mounted within a bore 72 in a housing 74. FIG. 4 shows that the valve spool 66 is maintained in a centered, neutral position by springs 76, 78 contained in respective end caps 80, 82.

The pins 60, 62 pass through holes in spacer plugs 84, 86 to engage respective ends of the valve spool 66, but the springs 76, 78 (and spring 64) maintain the valve block 26, slider block 44, bracket 42, and tubular portion 34 centered between flanges 52, 54.

The valve housing 74 is formed with three ports 88, 90, 92 on one side and two ports 94, 96 on the other side, corresponding with respective circumferential sets of holes 88A, 90A, 92A, 94A, 96A in the sleeve 70.

The valve spool 66 is formed with three lands 98, 100, 102, land 98 normally blocking port 88 and land 100 normally blocking port 90. Port 94 is connected to the hoist chamber 28 and open to the intermediate space, but is blocked from both port 88 and 90, so as to maintain existing pressure therein and hold the load 32 stationary.

Figure 5:
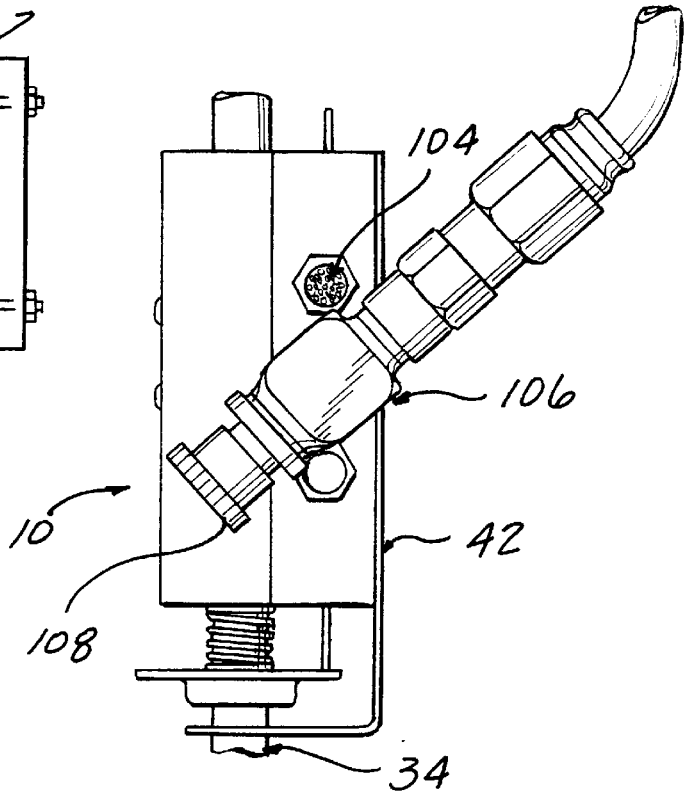
FIG. 5 is an enlarged fragmentary view of the control handle assembly shown in FIG. 1, illustrating a flow regulator connected to a line to the hoist fluid pressure manifold.

Port 88 is connected to a vent via a filter cup 104 and port 90 is connected to the pressure source 18 via manifold 16, line 22, and a variable flow restriction device 106 (FIG. 5), which can be adjusted by rotation of knob 108 to vary the flow rate when the pressure source allows flow to the hoist to control the rate of ascent.

When the tubular portion 34 is pulled down, land 98 is moved up by the pin 62 pushing on the valve spool 66, uncovering port 88 and allowing the air hoist chamber 28 to vent, causing the cable 30 to unwind under the weight of load 32. Similarly, an adjustable flow restriction in the manifold 16 controls the rate of flow of air out of the hoist chamber 28 to set the rate of descent of the load when the chamber is vented by pulling down of the handle 34.

When the tubular portion is pushed up, the pin 60 causes the valve spool 66 to shift down, uncovering port 90 and allowing air pressure to be applied to the air hoist chamber 28 at a rate set by the adjustment of the flow restriction device 106, raising the load 32 at a predetermined rate.

Ports 96 and 92 are not needed and may be blocked as shown in FIG. 4. The Numatics™ L2 series also include air pilot ports which are also not needed and may be blocked as unnecessary.

Other suitable three position valves can be used which have a spring centered neutral position.

I claim:

1. In combination, a control arrangement and a fluid pressure operated hoist, said hoist including an elongated flexible element, means causing said flexible element to be held stationary, wound up, or unwound by a fluid pressure chamber in said hoist, depending on whether said chamber is blocked, has fluid pressure applied therein, or is vented, said control arrangement including means for manually controlling the fluid pressure condition in said chamber, said means comprising:

a support rod attached to said hoist flexible element to be fixed relative thereto;

a handle assembly including a tubular movable handle portion manually slidable up and down on said support rod, and a bracket attached to one end of said tubular handle portion and extending alongside and offset to said support rod at a location vertically displaced from said handle;

a three position valve mounted to said bracket and offset from said support rod, said three position valve having a valving element movable in a bore in a valve housing to be positionable in three respective positions, a centered position, a down position, and an up position, means causing said hoist fluid pressure chamber to be blocked, connected to fluid pressure, and vented when said valve element is respectively in said centered, down, and up positions;

spring means normally holding said valve element in said centered position; and, means holding said valve element against movement relative said flexible element while allowing said valve housing to be moved with said bracket, whereby when said handle is manually pulled down, said valve element is shifted to said up position to cause lowering of a load attached to said flexible element, when said handle is manually pushed up said valve element is shifted to said down position to cause raising of said load, and said valve element is centered when said handle is released to hold said load stationary.

2. The control arrangement according to claim 1 further including a slider block slidable on said support rod and attached to said valve housing, whereby said valve housing is guided on said support rod.

3. The control arrangement according to claim 2 further including an auxiliary spring having one end anchored to said support rod and the other end acting on said slider block to support the weight of said slider block three position valve, bracket and tubular handle portion.

4. The control arrangement according to claim 1 further including a pair of spaced apart flanges, each attached to said support rod opposite a respective end of said valve housing, and a pair of centering pins each having one end engaging a respective flange, and an opposite end passing into said valve housing and engaging a respective end of said valve element, a pair of springs in said valve housing, each engaging a respective end of said valve element.

* * * * *